US010101694B2

(12) United States Patent
Koyama

(10) Patent No.: US 10,101,694 B2
(45) Date of Patent: Oct. 16, 2018

(54) FIXING DEVICE PROVIDED WITH A PLURALITY OF HEATERS

(71) Applicant: BROTHER KOGYO KABUSHIKI KAISHA, Nagoya-shi, Aichi-ken (JP)

(72) Inventor: Tatsuya Koyama, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/435,907

(22) Filed: Feb. 17, 2017

(65) Prior Publication Data

US 2017/0277089 A1 Sep. 28, 2017

(30) Foreign Application Priority Data

Mar. 28, 2016 (JP) ..... 2016-063197

(51) Int. Cl.
*G03G 15/00* (2006.01)
*G03G 15/20* (2006.01)
*G03G 21/16* (2006.01)

(52) U.S. Cl.
CPC ..... *G03G 15/2053* (2013.01); *G03G 15/2003* (2013.01); *G03G 15/2007* (2013.01); *G03G 15/2017* (2013.01); *G03G 15/80* (2013.01); *G03G 21/1652* (2013.01); *G03G 21/1685* (2013.01); *G03G 2215/2003* (2013.01); *G03G 2221/166* (2013.01); *G03G 2221/1639* (2013.01)

(58) Field of Classification Search
CPC ..... G03G 15/2003; G03G 15/2007; G03G 15/2017; G03G 15/2053; G03G 15/80; G03G 21/1652; G03G 21/1685; G03G 2215/2003; G03G 2221/1639; G03G 2221/166
See application file for complete search history.

(56) References Cited

U.S. PATENT DOCUMENTS

2006/0140690 A1 6/2006 Ito et al.
2015/0093161 A1* 4/2015 Takeuchi ..... G03G 15/2053 399/328

FOREIGN PATENT DOCUMENTS

JP 2006-184719 A 7/2006

* cited by examiner

*Primary Examiner* — Joseph S Wong
(74) *Attorney, Agent, or Firm* — Merchant & Gould P.C.

(57) ABSTRACT

A fixing device includes: a first heater including a first glass tube, a first heating body, and a first lead portion; a second heater including a second glass tube, a second heating body, and a second lead portion; a frame including first and second fixing surfaces; and a first terminal member including a first connection portion and a first fixed portion; and a second terminal member including a second connection portion and a second fixed portion. The first and second heaters are elongated in an elongated direction and arrayed in a first array direction. The first and second lead portions are fixed to the first and second connection portions, respectively. The first and second fixed portions are fixed to the first and second fixing surfaces, respectively, and arrayed in a second array direction. The first array direction is inclined relative to the second array direction when viewed in the elongated direction.

18 Claims, 5 Drawing Sheets

FIXING DEVICE PROVIDED WITH A PLURALITY OF HEATERS

CROSS REFERENCE TO RELATED APPLICATION

This application claims priority from Japanese Patent Application No. 2016-063197 filed Mar. 28, 2016. The entire content of the priority application is incorporated herein by reference.

TECHNICAL FIELD

The present disclosure relates to a fixing device.

BACKGROUND

A fixing device that is provided in a printer or a copier is well known in the art. One such fixing device known in the art is provided with a plurality of heaters having an elongated configuration. Specifically, one such fixing device is provided with a first heater having an elongated configuration; a second heater having an elongated configuration and aligned in an elongated direction of the first heater; a frame having a first fixing surface and a second fixing surface; a first terminal member; and a second terminal member.

The first terminal member includes a first connection portion to which one end portion of the first heater in the elongated direction is fixed and which is electrically connected to the first heater, and a first fixed portion which is fixed to the first fixing surface of the frame. The second terminal member includes a second connection portion to which one end portion of the second heater in the elongated direction is fixed and which is electrically connected to the first heater, and a second fixed portion which is fixed to the second fixing surface of the frame.

SUMMARY

In the fixing device provided with the first heater and the second heater described above, an array direction of heaters in which the first heater and the second heater are arrayed and an array direction of fixed portions in which the fixed portion of the first terminal member and the fixed portion of the second terminal member are arrayed are parallel to each other when viewed in the elongated direction. This arrangement causes one of a positional relationship between the heaters and a positional relationship between the fixed portions to depend on the other, which may lead to a problem in that a degree of freedom in design, for example, a degree of freedom in layout of the heaters and a degree of freedom in layout of the fixed portions are degraded.

In view of the foregoing, it is an object of the disclosure to provide a fixing device including a first heater and a second heater and capable of enhancing a degree of freedom in design.

In order to attain the above and other objects, the disclosure provides a fixing device including: a first heater; a second heater; a frame; a first terminal member; and a second terminal member. The first heater includes: a first glass tube elongated in an elongated direction and having one end in the elongated direction; a first heating body disposed inside the first glass tube; and a first lead portion protruding from the one end of the first glass tube and electrically connected to the first heating body. The second heater includes: a second glass tube elongated in the elongated direction and having one end in the elongated direction; a second heating body disposed inside the second glass tube; and a second lead portion protruding from the one end of the second glass tube and electrically connected to the second heating body. The first heater and the second heater are arrayed in a first array direction. The frame includes a first fixing surface and a second fixing surface. The first terminal member has a plate shape. The first terminal member includes: a first connection portion to which the first lead portion is fixed, the first connection portion being electrically connected to the first lead portion; and a first fixed portion fixed to the first fixing surface. The second terminal member has a plate shape. The second terminal member includes: a second connection portion to which the second lead portion is fixed, the second connection portion being electrically connected to the second lead portion; and a second fixed portion fixed to the second fixing surface. The first fixed portion and the second fixed portion are arrayed in a second array direction. The first array direction is inclined relative to the second array direction when viewed in the elongated direction.

According to another aspect, the disclosure provides a fixing device including: a first heater; a second heater; a frame; a first metal terminal member; a first connector; a second metal terminal member; and a second connector. The first heater includes: a first glass tube elongated in an elongated direction and having one end in the elongated direction; a first heating body disposed inside the first glass tube; and a first lead pin protruding from the one end of the first glass tube and electrically connected to the first heating body. The second heater includes: a second glass tube elongated in the elongated direction and having one end in the elongated direction; a second heating body disposed inside the second glass tube; and a second lead pin protruding from the one end of the second glass tube and electrically connected to the second heating body. The first heater and the second heater are arrayed in a first array direction. The frame includes a first fixing surface and a second fixing surface. The first metal terminal member includes: a first connection portion to which the first lead pin is fixed, the first connection portion being electrically connected to the first lead pin; and a first fixed portion fixed to the first fixing surface. The first connector is engaged with the first metal terminal member and electrically connected to the first metal terminal member. The second metal terminal member includes: a second connection portion to which the second lead pin is fixed, the second connection portion being electrically connected to the second lead pin; and a second fixed portion fixed to the second fixing surface. The first fixed portion and the second fixed portion are arrayed in a second array direction. The first array direction is inclined relative to the second array direction when viewed in the elongated direction. The second connector is engaged with the second metal terminal member and electrically connected to the second metal terminal member.

According to still another aspect, the disclosure provides a fixing device including: a first heater; a second heater; a frame; a first terminal member; and a second terminal member. The first heater includes: a first glass tube elongated in an elongated direction and having one end in the elongated direction; a first heating body disposed inside the first glass tube; and a first lead pin protruding from the one end of the first glass tube and electrically connected to the first heating body. The second heater includes: a second glass tube elongated in the elongated direction and having one end in the elongated direction; a second heating body disposed inside the second glass tube; and a second lead pin protruding from the one end of the second glass tube and electrically connected to the second heating body. The frame includes a first fixing surface and a second fixing surface. The first terminal member has a plate shape. The first terminal member includes: a first connection portion to which the first lead pin is fixed, the first connection portion being electrically connected to the first lead pin; a first fixed portion fixed to the first fixing surface; and a primary plate-shaped portion including the first connection portion. The second terminal member has a plate shape. The second terminal member includes: a second connection portion to which the second lead pin is fixed, the second connection portion being electrically connected to the second lead pin; a second fixed portion fixed to the second fixing surface; and a secondary plate-shaped portion including the second connection portion and extending in a prescribed direction from the first lead pin to the first connection portion. The secondary plate-shaped portion and the first lead pin are positioned on opposite sides of the second lead pin.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
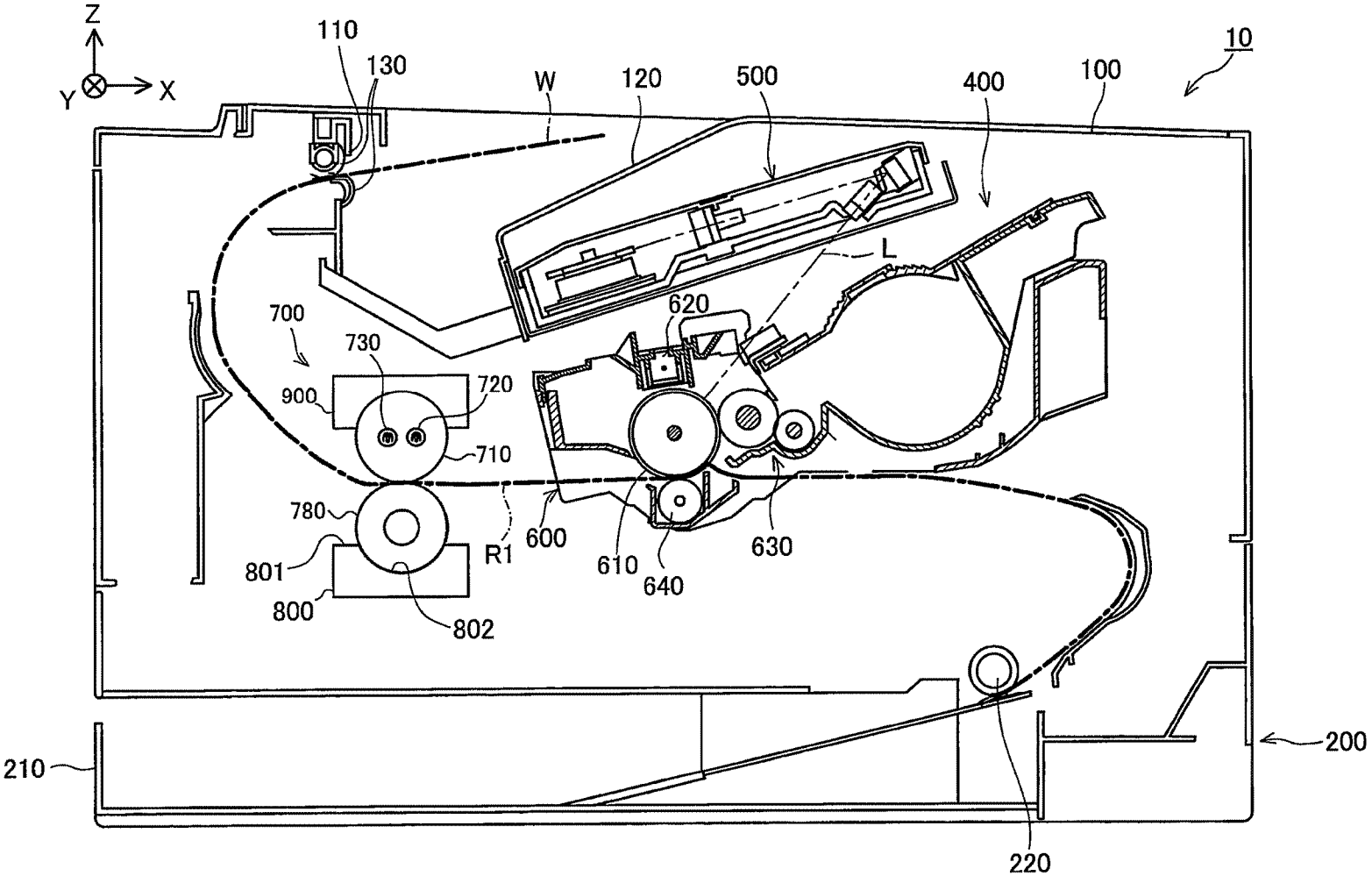
FIG. 1 is a schematic view illustrating a general structure of a printer 10 provided with a fixing device according to one embodiment.

A printer 10 provided with a fixing device according to one embodiment will be described with reference to FIG. 1, wherein like parts and components are designated by the same reference numerals to avoid duplicating description.

In FIG. 1, X, Y, and Z axes perpendicular to each other are illustrated to specify directions. In the following description, for the purpose of convenience, it is assumed that a positive Z-axis direction is defined as an upward direction for specifying an upper side of the printer 10, a negative Z-axis direction is defined as a downward direction for specifying a lower side of the printer 10, a positive X-axis direction is defined as a forward direction for specifying a front side of the printer 10, a negative X-axis direction is defined as a rearward direction for specifying a rear side of the printer 10, a positive Y-axis direction is defined as a rightward direction for specifying a right side of the printer 10, and a negative Y-axis direction is defined as a leftward direction for specifying a left side of the printer 10. The same applies to the drawings subsequent to FIG. 1.

The printer 10 is an electrophotographic type printer that forms an image on a sheet W such as a recording sheet or an OHP sheet using a single-color (for example, black) toner (developer).

As illustrated in FIG. 1, the printer 10 includes a casing 100, a sheet supply section 200, and an image forming section 400. The casing 100 accommodates the sheet supply section 200 and the image forming section 400. A discharge port 110 and a discharge tray 120 are formed on a top surface of the casing 100. Further, a discharge roller 130 is provided in the vicinity of the discharge port 110 in the casing 100.

The sheet supply section 200 includes a tray 210 and a pickup roller 220. The tray 210 is a container that contains sheets W. The pickup roller 220 picks up the sheets W contained in the tray 210 one by one from the tray 210 and conveys the picked-up sheet to the image forming section 400.

The image forming section 400 includes an exposure unit 500, a process unit 600, and a fixing device 700. The exposure unit 500 irradiates a photosensitive body 610 of the process unit 600 with a laser beam L (light beam).

The process unit 600 includes the photosensitive body 610, a charging unit 620, a developing unit 630, and a transfer roller 640. The charging unit 620 uniformly charges a surface of the photosensitive body 610. When the surface of the photosensitive body 610 charged by the charging unit 620 is irradiated with the laser beam L from the exposure unit 500, an electrostatic latent image is formed on the surface of the photosensitive body 610. When the surface of the photosensitive body 610 is supplied with toner by the developing unit 630, the electrostatic latent image formed on the surface of the photosensitive body 610 is developed to form a toner image. The toner image formed on the surface of the photosensitive body 610 is transferred onto a sheet W passing through a position between the photosensitive body 610 and the transfer roller 640 by the transfer roller 640.

The fixing device 700 heats the sheet W passing through the process unit 600 and fixes the toner image transferred onto the sheet W to the sheet W. Accordingly, an image is formed on the sheet W. The detailed configuration of the fixing device 700 will be described later. The discharge roller 130 discharges the sheet W passing through the fixing device 700 to the discharge tray 120 via the discharge port 110. Hereinafter, a conveyance path of a sheet W from the sheet supply section 200 to the discharge roller 130 will be referred to as a conveyance path R1.

Next, the fixing device 700 will be described in detail.

As illustrated in FIG. 1, the fixing device 700 includes a heating roller 710, a first heater 720 and a second heater 730 that are accommodated in the heating roller 710, a top cover 900 that covers a top end portion (downstream end portion in the positive Z-axis direction) of the heating roller 710, a pressure roller 780 that is disposed on the lower side (downstream side in the negative Z-axis direction) of the heating roller 710, and a bottom cover 800 that covers a bottom end portion (downstream end portion in the negative Z-axis direction) of the pressure roller 780.

Figure 2:
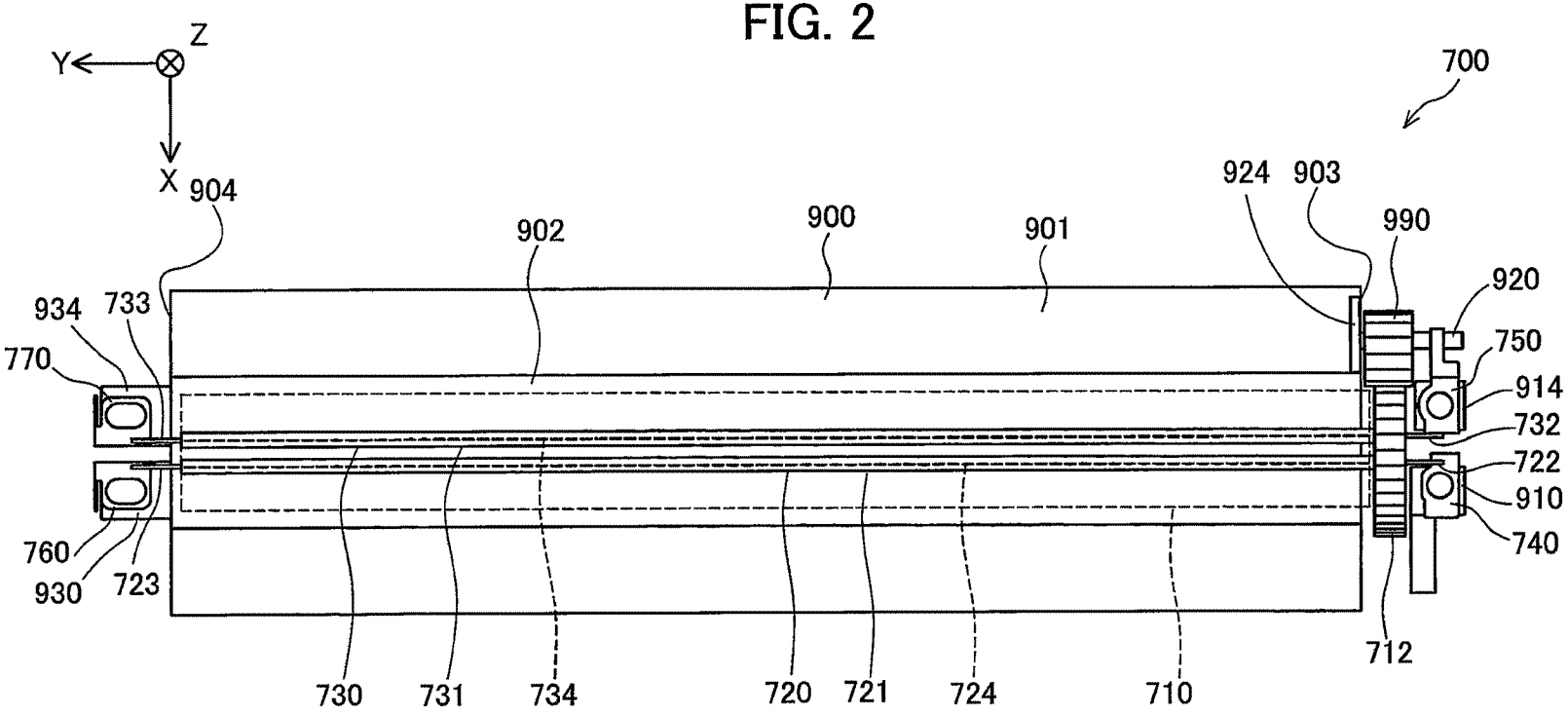
FIG. 2 is a bottom view of a top cover 900, a first heater 720, and a second heater 730 provided at the fixing device according to the embodiment.

As illustrated in FIG. 2, the fixing device 700 further includes a first left terminal member 740 and a second left terminal member 750 that are disposed on the left side (downstream side in the negative Y-axis direction) of the top cover 900, and a first right terminal member 760 and a second right terminal member 770 that are disposed on the right side (downstream side in the positive Y-axis direction) of the top cover 900. The first left terminal member 740 is an example of a first terminal member, and the second left terminal member 750 is an example of a second terminal member.

Figure 3:
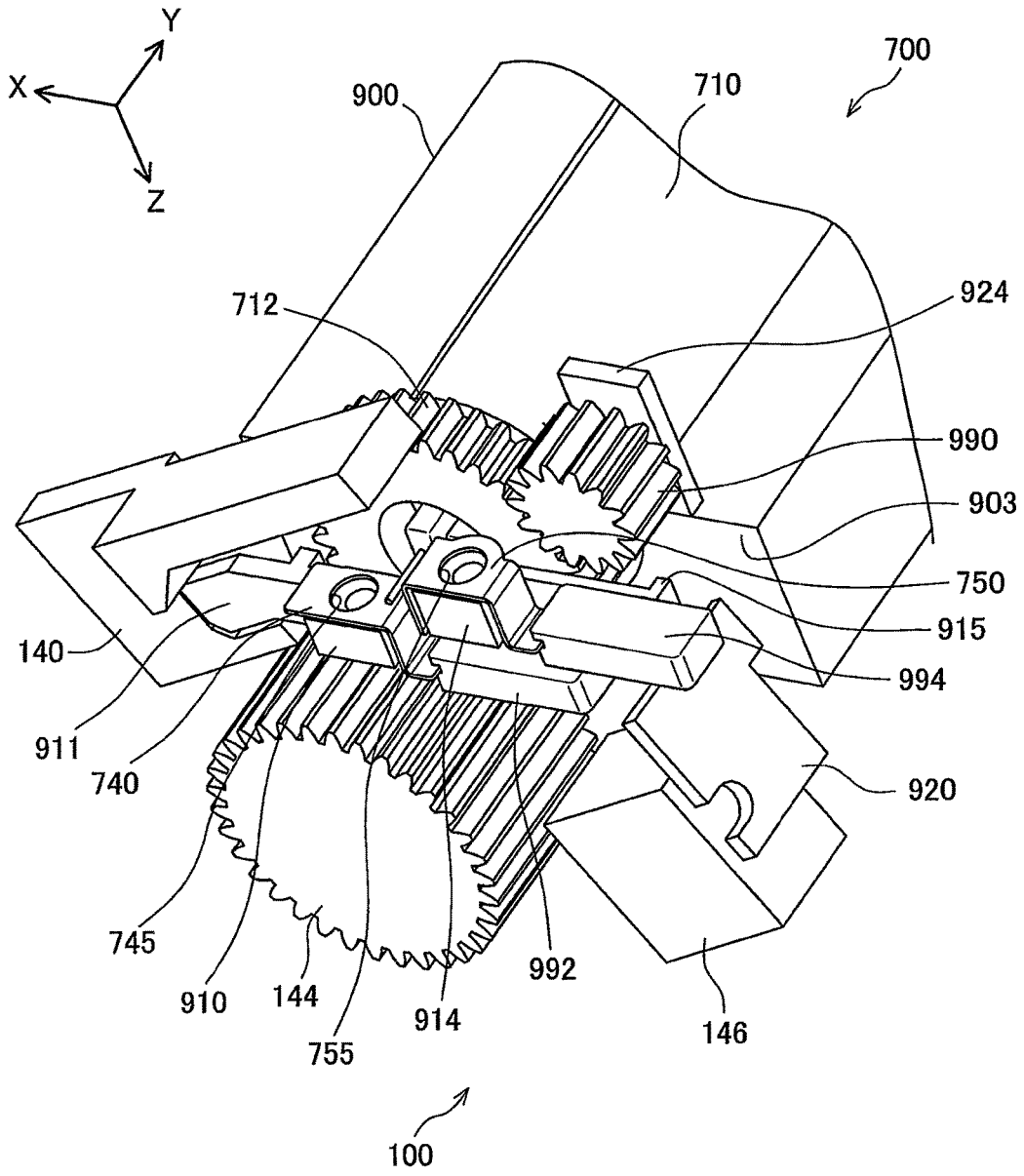
FIG. 3 is a perspective view of a left end portion of the top cover 900, a first left terminal member 740, and a second left terminal member 750 provided at the fixing device according to the embodiment.

As illustrated in FIGS. 2 and 3, the heating roller 710 is a cylindrical member. The heating roller 710 extends in a direction that is aligned in a left-right direction (the Y-axis direction). Note that, in the description, the expression "aligned in (a target direction)" means "substantially parallel to the target direction", and more specifically, includes a case in which an angular difference between the actual direction and the target direction is not greater than 10 degrees as well as a case in which the actual direction is completely parallel to the target direction. The heating roller 710 is rotatable about a rotation axis that is substantially parallel to the left-right direction.

A first gear 712 is attached to a left end portion of the heating roller 710. The first gear 712 is disposed on the left side (downstream side in the negative Y-axis direction) relative to a left end face 903 of the top cover 900. The first gear 712 has a cylindrical shape and meshingly engages with a driven gear 990 to be described later. The first gear 712 also meshingly engages with a second gear 144 provided in the casing 100 and receives a driving force from the second gear 144. Upon transmission of the driving force from the second gear 144, the first gear 712 rotates the heating roller 710 and the driven gear 990.

The first heater 720 and the second heater 730 are heating members having an elongated configuration. Specifically, the first heater 720 and the second heater 730 are halogen heaters. The first heater 720 is elongated in a direction that is aligned in the left-right direction (the Y-axis direction). The second heater 730 is disposed on the rear side (downstream side in the negative X-axis direction) of the first heater 720 and elongated in a direction that is aligned in the elongated direction of the first heater 720. That is, the first heater 720 and the second heater 730 are arrayed in a front-rear direction (the X-axis direction).

Hereinafter, the front-rear direction will also be referred to as an "array direction of heaters". Specifically, the "array direction of heaters" (L1 in FIG. 4) implies a direction that a center axis of a first glass tube 721 (described later) and a center axis of a second glass tube 731 (described later) are arrayed when viewed in the elongated direction of the first heater 720. The array direction of heaters L1 is an example of a first array direction.

As illustrated in FIG. 2, the first heater 720 includes the first glass tube 721, a first heating body 724, a first left lead pin 722, and a first right lead pin 723.

The first glass tube 721 is a cylindrical glass member. The first glass tube 721 is elongated in a direction that is aligned in the left-right direction. The first heating body 724 is disposed on the inner circumferential side of the first glass tube 721 so as to be aligned in the left-right direction (the Y-axis direction). The first heating body 724 is, for example, a filament. The first left lead pin 722 protrudes to the left side (downstream side in the negative Y-axis direction) from a left end of the first glass tube 721 and is electrically connected to the first heating body 724. The first right lead pin 723 protrudes to the right side (downstream side in the positive Y-axis direction) from a right end of the first glass tube 721 and is electrically connected to the first heating body 724. The first left lead pin 722 is an example of a first lead pin. The first left lead pin 722 is also an example of a first lead portion.

The second heater 730 includes the second glass tube 731, a second heating body 734, a second left lead pin 732, and a second right lead pin 733.

The second glass tube 731 is a cylindrical glass member. The second glass tube 731 is elongated in a direction that is aligned in the left-right direction. The second heating body 734 is disposed on the inner circumferential side of the second glass tube 731 so as to be aligned in the left-right direction (the Y-axis direction). The second heating body 734 is, for example, a filament. The second left lead pin 732 protrudes to the left side (downstream side in the negative Y-axis direction) from a left end of the second glass tube 731 and is electrically connected to the second heating body 734. The first left lead pin 722 and the second left lead pin 732 are arrayed in the front-rear direction (the X-axis direction), that is, in the array direction of heaters, when viewed in the elongated direction of the first heater 720. The second right lead pin 733 protrudes to the right side (downstream side in the positive Y-axis direction) from a right end of the second glass tube 731 and is electrically connected to the second heating body 734. The first right lead pin 723 and the second right lead pin 733 are arrayed in the front-rear direction (the X-axis direction), that is, in the array direction of heaters, when viewed in the elongated direction of the first heater 720. The second left lead pin 732 is an example of a second lead pin. The second left lead pin 732 is also an example of a second lead portion.

As illustrated in FIGS. 1 and 2, the top cover 900 and the conveyance path R1 are disposed on opposite sides of the heating roller 710. The top cover 900 is a columnar member. The top cover 900 is elongated in a direction that is aligned in the left-right direction (the Y-axis direction). An arcuate-shaped groove 902 is formed in a surface 901 of the top cover 900 facing the pressure roller 780. The top end portion of the heating roller 710 is accommodated in the groove 902. The top cover 900 is an example of a frame.

Figure 4:
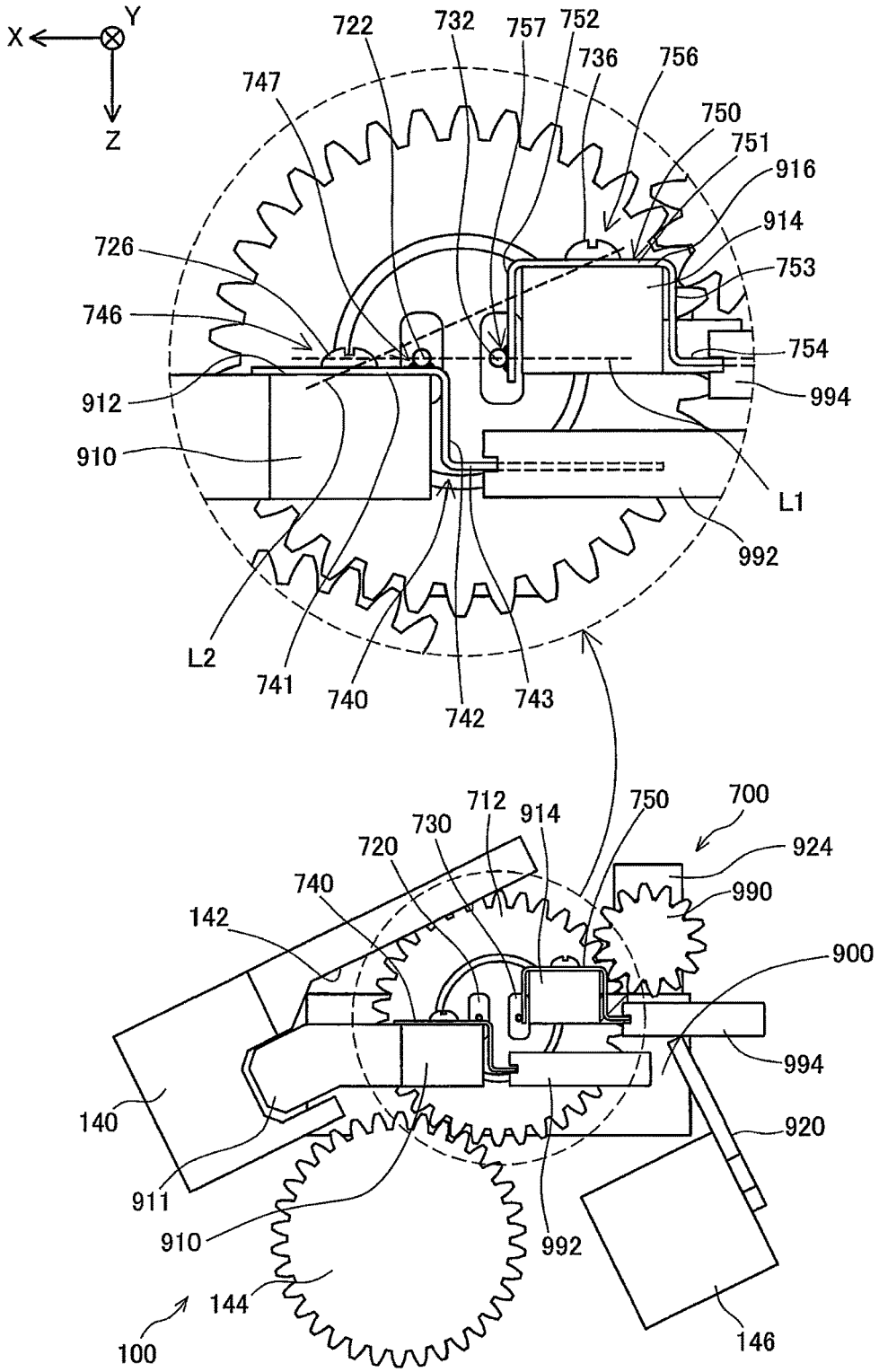
FIG. 4 is a left side view of the top cover 900, the first heater 720, the second heater 730, the first left terminal member 740, and the second left terminal member 750 provided at the fixing device according to the embodiment.

As illustrated in FIGS. 2 through 4, the top cover 900 includes a first left fixing portion 910, a second left fixing portion 914, a coupling portion 920, and an attachment portion 924. The first left fixing portion 910, the second left fixing portion 914, and the coupling portion 920 are disposed on the left end face 903 of the top cover 900. The first left fixing portion 910 and the second left fixing portion 914 are rectangular parallelepiped members. The first left fixing portion 910 and the second left fixing portion 914 are disposed on the left side (downstream side in the negative Y-axis direction) relative to the first gear 712. The first left fixing portion 910 is disposed on the upper side (downstream side in the positive Z-axis direction) of the first left lead pin 722 and also disposed on the front side (downstream side in the positive X-axis direction) of the second left lead pin 732 when viewed in the elongated direction (the Y-axis direction) of the first heater 720. The first left fixing portion 910 is connected to the left end face 903 of the top cover 900 via a first connecting portion 911. A bottom end surface of the first left fixing portion 910 constitutes a first fixing surface 912. The second left fixing portion 914 is disposed on the rear side (downstream side in the negative X-axis direction) of the second left lead pin 732 when viewed in the elongated direction of the first heater 720. The second left fixing portion 914 is connected to the left end face 903 of the top cover 900 via a second connecting portion 915. A bottom end surface of the second left fixing portion 914 constitutes a second fixing surface 916.

The first left fixing portion 910 and the second left fixing portion 914 are disposed so as to be separated from each other in the front-rear direction (the X-axis direction) and are also disposed at different positions from each other in an upper-lower direction. Specifically, when viewed in the elongated direction (the Y-axis direction) of the first heater 720, the second left fixing portion 914 is disposed on the diagonally lower-rear side relative to the first left fixing portion 910.

The coupling portion 920 is a plate-shaped member. The coupling portion 920 is disposed on the diagonally upper-rear side relative to the first left lead pin 722 and the second left lead pin 732 when viewed in the elongated direction (the Y-axis direction) of the first heater 720. The coupling portion 920 protrudes to the left side (downstream side in the negative Y-axis direction) from the left end face 903 of the top cover 900. The coupling portion 920 is fixed to a fixing portion 146 provided in the casing 100 by a screw, for example.

The attachment portion 924 is a plate-shaped member. The attachment portion 924 is disposed on the diagonally lower-rear side relative to the first left lead pin 722 and the second left lead pin 732 when viewed in the elongated direction (the Y-axis direction) of the first heater 720. The attachment portion 924 protrudes to the lower side (downstream side in the negative Z-axis direction) from the surface 901 of the top cover 900. The driven gear 990 is rotatably attached to a left surface of the attachment portion 924.

As illustrated in FIG. 2, the top cover 900 further includes a first right fixing portion 930 and a second right fixing portion 934. The first right fixing portion 930 and the second right fixing portion 934 are disposed on a right end face 904 of the top cover 900. The first right fixing portion 930 and the second right fixing portion 934 are rectangular parallelepiped members. The first right fixing portion 930 and the second right fixing portion 934 protrude to the right side (downstream side in the positive Y-axis direction) from the right end face 904 of the top cover 900. The first right fixing portion 930 is disposed on the upper side (downstream side in the positive Z-axis direction) of the first right lead pin 723 and on the front side (downstream side in the positive X-axis direction) of the second right lead pin 733. The second right fixing portion 934 is disposed on the upper side of the second right lead pin 733 and on the rear side (downstream side in the negative X-axis direction) of the first right lead pin 723. The first right fixing portion 930 and the second right fixing portion 934 are disposed so as to be separated from each other in the front-rear direction (the X-axis direction).

As illustrated in FIG. 1, the pressure roller 780 is disposed on the opposite side of the heating roller 710 with respect to the conveyance path R1. The pressure roller 780 is disposed so as to contact the heating roller 710. The pressure roller 780 is a cylindrical member. The pressure roller 780 extends in a direction that is aligned in the left-right direction (the Y-axis direction). The pressure roller 780 is rotatable about a rotation axis that is substantially parallel to the left-right direction. The pressure roller 780 is pressed against the heating roller 710 to provide a nip region formed between the heating roller 710 and the pressure roller 780.

As illustrated in FIG. 1, the bottom cover 800 is disposed on the opposite side of the heating roller 710 with respect to the pressure roller 780. The bottom cover 800 is a columnar member. The bottom cover 800 is elongated in a direction that is aligned in the left-right direction (the Y-axis direction). An arcuate-shaped groove 802 is formed in a surface 801 of the bottom cover 800 facing the pressure roller 780. The bottom end portion of the pressure roller 780 is accommodated in the groove 802.

As illustrated in FIGS. 3 and 4, the first left terminal member 740 is a plate-shaped member formed of metal. The first left terminal member 740 is bent into a stepped shape. The first left terminal member 740 has three plate-shaped portions including a first plate-shaped portion 741, a first intermediate portion 742, and a first tip portion 743. The first plate-shaped portion 741 is also an example of a primary plate-shaped portion.

The first plate-shaped portion 741 is disposed so as to be aligned in the array direction of heaters (the X-axis direction) when viewed in the elongated direction (the Y-axis direction) of the first heater 720. The first intermediate portion 742 is bent from a rear end of the first plate-shaped portion 741 toward the upper side (downstream side in the positive Z-axis direction) thereof when viewed in the elongated direction (the Y-axis direction) of the first heater 720. The first intermediate portion 742 extends in the upper-lower direction when viewed in the elongated direction (the Y-axis direction) of the first heater 720. The first tip portion 743 is bent from a top end of the first intermediate portion 742 toward the rear side (downstream side in the negative X-axis direction) thereof when viewed in the elongated direction (the Y-axis direction) of the first heater 720. The first tip portion 743 extends in the front-rear direction (the X-axis direction) when viewed in the elongated direction (the Y-axis direction) of the first heater 720.

The first plate-shaped portion 741 is disposed on the first fixing surface 912 of the first left fixing portion 910. A through-hole 745 is formed in the first plate-shaped portion 741. The first plate-shaped portion 741 is fixed to the first fixing surface 912 of the first left fixing portion 910 by a screw 726 extending through the through-hole 745 in a downward direction (the negative Z-axis direction). Hereinafter, a portion at which the first plate-shaped portion 741 is fixed to the first fixing surface 912 will be referred to as a first fixed portion 746. The "first fixed portion 746" specifically means the center of the through-hole 745 at a top surface of the first plate-shaped portion 741 at which the first plate-shaped portion 741 contacts the first fixing surface 912 of the first left fixing portion 910. The first plate-shaped portion 741 includes the first fixed portion 746. A direction from the first fixed portion 746 to the first fixing surface 912 is parallel to the upper-lower direction. Incidentally, FIGS. 2 and 3 illustrate the first left terminal member 740 before being fixed to the first fixing surface 912 by the screw 726, while FIG. 4 illustrates the first left terminal member 740 after being fixed to the first fixing surface 912 by the screw 726. The same applies to the second left terminal member 750.

The first left lead pin 722 is welded to the first plate-shaped portion 741, and thus, the first left lead pin 722 and the first left terminal member 740 are electrically connected to each other. The first left lead pin 722 is disposed on the lower side (downstream side in the negative Z-axis direction) of the first plate-shaped portion 741 and is welded to a bottom surface of the first plate-shaped portion 741. Hereinafter, a portion at which the first left lead pin 722 is fixed to the first plate-shaped portion 741 will be referred to as a first connection portion 747. The "first connection portion 747" specifically means the center of a position at which a welding agent for welding the first left lead pin 722 and the first plate-shaped portion 741 contacts the first plate-shaped portion 741. The first plate-shaped portion 741 includes the first connection portion 747. A direction from the first left lead pin 722 to the first connection portion 747 is parallel to the upper-lower direction. More specifically, the direction from the first left lead pin 722 to the first connection portion 747 is substantially the same direction as the positive Z-axis direction (i.e. upward direction). The direction from the first left lead pin 722 to the first connection portion 747 is an example of a prescribed direction.

The first intermediate portion 742 is disposed along a surface on the rear side (downstream side in the negative X-axis direction), i.e. a rear surface, of the first left fixing portion 910. When viewed in the elongated direction (the Y-axis direction) of the first heater 720, the first intermediate portion 742 is disposed between the first left lead pin 722 and the second left lead pin 732 in the front-rear direction (the X-axis direction) and also between the first left fixing portion 910 and the second left fixing portion 914 in the front-rear direction (the X-axis direction). The first intermediate portion 742 is an example of a fourth plate-shaped portion.

The first tip portion 743 is disposed on the rear side (downstream side in the negative X-axis direction) of the first left fixing portion 910. The first tip portion 743 engages with a first connector 992 provided at the fixing device 700, as indicated by a dashed line in FIG. 4. Accordingly, the first heater 720 is electrically connected to the first connector 992 via the first intermediate portion 742 and the first tip portion 743, and the first heater 720 is supplied with electric power through the first connector 992. The first intermediate portion 742 and the first tip portion 743 constitute a first electrical connection portion. The first intermediate portion 742 and the first tip portion 743 are an example of a first electrical connection portion.

The second left terminal member 750 is a plate-shaped member formed of metal. The second left terminal member 750 is bent into a key shape. The second left terminal member 750 has four plate-shaped portions including a second plate-shaped portion 751, a third plate-shaped portion 752, a second intermediate portion 753, and a second tip portion 754. The second plate-shaped portion 751 is also an example of a tertiary plate-shaped portion. The third plate-shaped portion 752 is also an example of a secondary plate-shaped portion.

The second plate-shaped portion 751 is disposed so as to be aligned in the array direction of heaters (the X-axis direction) when viewed in the elongated direction (the Y-axis direction) of the first heater 720. The third plate-shaped portion 752 is bent from a front end of the second plate-shaped portion 751 toward the upper side (downstream side in the positive Z-axis direction) thereof when viewed in the elongated direction (the Y-axis direction) of the first heater 720. The third plate-shaped portion 752 extends in the upper-lower direction when viewed in the elongated direction (the Y-axis direction) of the first heater 720. The second intermediate portion 753 is bent from a rear end of the second plate-shaped portion 751 toward the upper side (downstream side in the positive Z-axis direction) thereof when viewed in the elongated direction (the Y-axis direction) of the first heater 720. The second intermediate portion 753 extends in the upper-lower direction when viewed in the elongated direction (the Y-axis direction) of the first heater 720. The second tip portion 754 is bent from an upper end of the second intermediate portion 753 toward the rear side (downstream side in the negative X-axis direction) thereof when viewed in the elongated direction (the Y-axis direction) of the first heater 720. The second tip portion 754 extends in the front-rear direction (the X-axis direction) when viewed in the elongated direction (the Y-axis direction) of the first heater 720.

The second plate-shaped portion 751 is disposed on the second fixing surface 916 of the second left fixing portion 914. A through-hole 755 is formed in the second plate-shaped portion 751. The second plate-shaped portion 751 is fixed to the second fixing surface 916 of the second left fixing portion 914 by a screw 736 extending through the through-hole 755 in the downward direction (the negative Z-axis direction). Hereinafter, a portion at which the second plate-shaped portion 751 is fixed to the second fixing surface 916 will be referred to as a second fixed portion 756. The "second fixed portion 756" specifically means the center of the through-hole 755 at a top surface of the second plate-shaped portion 751 at which the second plate-shaped portion 751 contacts the second fixing surface 916 of the second left fixing portion 914. The second plate-shaped portion 751 includes the second fixed portion 756. A direction from the second fixed portion 756 to the second fixing surface 916 is parallel to the upper-lower direction.

As illustrated in FIG. 4, the second fixed portion 756 is disposed at a position different from the first fixed portion 746 in the upper-lower direction (the Z-axis direction). Specifically, when viewed in the elongated direction (the Y-axis direction) of the first heater 720, the second left fixing portion 914 is disposed on the diagonally lower-rear side relative to the first left fixing portion 910.

Therefore, an array direction of fixed portions (L2) in which the first fixed portion 746 and the second fixed portion 756 are arrayed is inclined relative to the array direction of heaters (L1) when viewed in the elongated direction (the Y-axis direction) of the first heater 720. Here, the "array direction of fixed portions" specifically means a direction connecting the center of the through-hole 745 of the first left terminal member 740 and the center of the through-hole 755 of the second left terminal member 750 when viewed in the elongated direction of the first heater 720. The "array direction of fixed portions" also means a direction connecting the center of the first fixing surface 912 of the first left fixing portion 910 and the center of the second fixing surface 916 of the second left fixing portion 914 when viewed in the elongated direction of the first heater 720. The array direction of fixed portions L2 is an example of a second array direction.

The second fixed portion 756 is disposed at a position overlapping at least a part of the first tip portion 743 of the first left terminal member 740 when viewed in the upper-lower direction. In the upper-lower direction, the second fixed portion 756 is disposed on the opposite side of the first tip portion 743 with respect to the second left fixing surface 916.

The third plate-shaped portion 752 is disposed along a surface on the front side (downstream side in the positive X-axis direction), i.e. a front surface, of the second left fixing portion 914. The third plate-shaped portion 752 is also disposed on the rear side (downstream side in the negative X-axis direction) of the second left lead pin 732. The second left lead pin 732 is welded to the third plate-shaped portion 752, and thus, the second left lead pin 732 and the second left terminal member 750 are electrically connected to each other. The second left lead pin 732 is disposed on the front side of the third plate-shaped portion 752 and is welded to a front surface of the third plate-shaped portion 752. That is, the second left lead pin 732 is disposed on the same side as the first left lead pin 722 with respect to the third plate-shaped portion 752. Hereinafter, a portion at which the second left lead pin 732 is fixed to the second plate-shaped portion 751 will be referred to as a second connection portion 757.

The "second connection portion 757" specifically means the center of a position at which a welding agent for welding the second left lead pin 732 and the second plate-shaped portion 751 contacts the second plate-shaped portion 751. The third plate-shaped portion 752 includes the second connection portion 757. A direction from the second left lead pin 732 to the second connection portion 757 is parallel to the front-rear direction (the X-axis direction). The second connection portion 757 is disposed on the inner side relative to both ends (i.e. top end and bottom end) of the third plate-shaped portion 752 in the upper-lower direction (the Z-axis direction). In other words, the second connection portion 757 is disposed between the top end and the bottom end of the third plate-shaped portion 752 in the upper-lower direction (the Z-axis direction).

The third plate-shaped portion 752 has an upstream end and a downstream end in the direction from the first left lead pin 722 to the first connection portion 747 (the positive Z-axis direction). The upstream end of the third plate-shaped portion 752 is positioned on the upstream side relative to the first left lead pin 722 in the direction from the first left lead pin 722 to the first connection portion 747. The downstream end of the third plate-shaped portion 752 is positioned on the downstream side relative to the first left lead pin 722 in the direction from the first left lead pin 722 to the first connection portion 747. Further, the upstream end of the third plate-shaped portion 752 is positioned on the upstream side relative to the second left lead pin 732 in the direction from the first left lead pin 722 to the first connection portion 747. The downstream end of the third plate-shaped portion 752 is positioned on the downstream side relative to the second left lead pin 732 in the direction from the first left lead pin 722 to the first connection portion 747. In other words, an upper end of the third plate-shaped portion 752 is positioned upward of the first left lead pin 722 and the second left lead pin 732 in the upper-lower direction, while a lower end of the third plate-shaped portion 752 is positioned downward of the first left lead pin 722 and the second left lead pin 732 in the upper-lower direction.

The second intermediate portion 753 is disposed along a surface on the rear side (downstream side in the negative X-axis direction), i.e. a rear surface, of the second left fixing portion 914. The second intermediate portion 753 is disposed on the opposite side of the second left lead pin 732 with respect to the second left fixing portion 914 in the front-rear direction (the X-axis direction) when viewed in the elongated direction (the Y-axis direction) of the first heater 720. The second intermediate portion 753 is an example of a fifth plate-shaped portion.

The second tip portion 754 is disposed on the rear side (downstream side in the negative X-axis direction) of the second left fixing portion 914. The second tip portion 754 engages with a second connector 994 provided at the fixing device 700, as indicated by a dashed line in FIG. 4. Accordingly, the second heater 730 is electrically connected to the second connector 994 via the second intermediate portion 753 and the second tip portion 754, and the second heater 730 is supplied with electric power through the second connector 994. The second intermediate portion 753 and the second tip portion 754 constitute a second electrical connection portion. The second intermediate portion 753 and the second tip portion 754 are an example of a second electrical connection portion.

As illustrated in FIG. 2, the first right terminal member 760 is a plate-shaped member formed of metal. The first right terminal member 760 is fixed to a bottom end surface of the first right fixing portion 930. The first right lead pin 723 is welded to the first right terminal member 760, and thus, the first right lead pin 723 and the first right terminal member 760 are electrically connected to each other.

The second right terminal member 770 is a plate-shaped member formed of metal. The second right terminal member 770 is fixed to a bottom end surface of the second right fixing portion 934. The second right lead pin 733 is welded to the second right terminal member 770, and thus, the second right lead pin 733 and the second right terminal member 770 are electrically connected to each other.

The fixing device 700 is detachably attached to the casing 100. At the time of attachment to the casing 100, the fixing device 700 is moved diagonally rearward and forward relative to the casing 100, when viewed in the elongated direction (the Y-axis direction) of the first heater 720, to bring a front end portion of the first connecting portion 911 into contact with a positioning member 140 provided in the casing 100. The first connecting portion 911 is further moved along an inclined surface 142 of the positioning member 140 to fix the fixing device 700 in position relative to the casing 100. Accordingly, the first gear 712 meshingly engages with the second gear 144. By fixing the coupling portion 920 to the fixing portion 146 with a screw or the like, the fixing device 700 is fixed to the casing 100.

In the present embodiment, when viewed in the elongated direction of the first heater 720, the array direction of fixed portions (L2, see FIG. 4) in which the first fixed portion 746 and the second fixed portion 756 are arrayed is inclined relative to the array direction of heaters (L1, the X-axis direction, see FIG. 4). Accordingly, in comparison with a case in which the array direction of fixed portions is parallel to the array direction of heaters, a degree of freedom in designing the fixing device 700 can be enhanced.

If the array direction of fixed portions is parallel to the array direction of heaters, one of a positional relationship between the heaters and a positional relationship between the fixed portions may depend on the other. Accordingly, for example, if the layouts of the heaters cannot be freely set, heating regions of the heaters cannot be freely set, and thus, there may be a problem in that heating performance of the fixing device is restricted. Further, if the layouts of the fixed portions cannot be freely set, there may be a problem in that it is difficult to make the fixing device more compact. In the present embodiment, the array direction of fixed portions (L2) is inclined relative to the array direction of heaters (L1). That is, the array direction of fixed portions (L2) is not parallel to the array direction of heaters (L1). Therefore, occurrence of the above-described problems can be suppressed.

Specifically, in the first left terminal member 740, the first connection portion 747 and the first fixed portion 746 are disposed at the first plate-shaped portion 741 that is aligned in the array direction of heaters (the X-axis direction). On the other hand, in the second left terminal member 750, the second fixed portion 756 is disposed at the second plate-shaped portion 751 that is aligned in the array direction of heaters while the second connection portion 757 is disposed at the third plate-shaped portion 752 that is bent from the second plate-shaped portion 751 toward the upper side (downstream side in the positive Z-axis direction) thereof and that extends in the upper-lower direction. Accordingly, when viewed in the elongated direction of the first heater 720, the first connection portion 747 and the first fixed portion 746 are located at the same position in the upper-lower direction, but the second connection portion 757 and the second fixed portion 756 are located at different positions in the upper-lower direction. As a result, the array direction of fixed portions can be inclined relative to the array direction of heaters.

In the present embodiment, the first tip portion 743 is aligned in the front-rear direction (the X-axis direction) and disposed on the rear side (downstream side in the negative X-axis direction) of the first left fixing portion 910. Accordingly, in comparison with a case in which the first tip portion 743 is disposed on the front side (downstream side in the positive X-axis direction) of the first left fixing portion 910, the first tip portion 743 and the second tip portion 754 can be prevented from interfering with other members provided in the casing 100 when the fixing device 700 is attached to the casing 100.

In the present embodiment, in order to realize the above-described configuration, the second left fixing portion 914 is disposed at a position offset to the lower side (downstream side in the negative Z-axis direction) from the first left fixing portion 910 in the upper-lower direction, and the first tip portion 743 is disposed in the space on the upper side (the positive Z-axis direction) of the second left fixing portion 914 formed by this arrangement. That is, the first tip portion 743 is disposed on the opposite side of the second fixed portion 756 with respect to the second fixing surface 916 in the upper-lower direction. Accordingly, in comparison with a case in which the first tip portion 743 is disposed on the same side as the second fixed portion 756 with respect to the second fixing surface 916, a space can be secured for an operation for fixing the second plate-shaped portion 751 to the second fixing surface 916. Further, when viewed in the elongated direction of the first heater 720, the first left fixing portion 910, the second left fixing portion 914, and the first tip portion 743 can be positioned closely to one another in the upper-lower direction.

Specifically, the first intermediate portion 742 is bent from the rear end of the first plate-shaped portion 741 toward the upper side (downstream side in the positive Z-axis direction) thereof and extends in the upper-lower direction. Accordingly, in comparison with a case in which the first intermediate portion 742 is not bent from the first plate-shaped portion 741, the distance between the first plate-shaped portion 741 and the second left terminal member 750 can be reduced.

In addition, the first tip portion 743 is bent from the top end of the first intermediate portion 742 toward the upper side (downstream side in the positive Z-axis direction) thereof and extends in the front-rear direction (the X-axis direction). In the present embodiment, when viewed in the upper-lower direction, at least a part of the first tip portion 743 overlaps the second fixed portion 756. Accordingly, in comparison with a case in which no portion of the first tip portion 743 overlaps the second fixed portion 756, the distance between the first left terminal member 740 and the second left terminal member 750 can be decreased. Accordingly, as illustrated in FIG. 4, when viewed in the elongated direction of the first heater 720, the first left terminal member 740 and the second left terminal member 750 except for the second tip portion 754 can be disposed within an addendum circle of the first gear 712.

In the present embodiment, the second left fixing portion 914 is disposed on the lower side (downstream side in the negative Z-axis direction) relative to the first left fixing portion 910 in the upper-lower direction, and thus, the second plate-shaped portion 751 is disposed offset to the lower side from the first plate-shaped portion 741. Further, the second left terminal member 750 is provided with the third plate-shaped portion 752 that is bent from the second plate-shaped portion 751 toward the upper side (downstream side in the positive Z-axis direction) thereof and that extends in the upper-lower direction. The second left lead pin 732 is connected to the third plate-shaped portion 752. Hence, even though the second plate-shaped portion 751 is disposed offset in the upper-lower direction from the first plate-shaped portion 741, the first heater 720 and the second heater 730 can be arrayed in the array direction of heaters (the X-axis direction).

In the present embodiment, the second left lead pin 732 is disposed on the same side as the first left lead pin 722 with respect to the third plate-shaped portion 752 in the front-rear direction (the X-axis direction). That is, in the array direction of heaters, the third plate-shaped portion 752 is not disposed between the first left lead pin 722 and the second left lead pin 732. Accordingly, in comparison with a case in which the third plate-shaped portion 752 is disposed between the first left lead pin 722 and the second left lead pin 732 in the array direction of heaters, the distance in the array direction of heaters between the first heater 720 and the second heater 730 can be decreased, thereby making the fixing device 700 more compact. Further, the distance between the first left terminal member 740 and the second left terminal member 750 can be secured, thereby securing the electrical insulation between the first left terminal member 740 and the second left terminal member 750.

In the present embodiment, the second connection portion 757 is disposed on the inner side relative to both ends of the third plate-shaped portion 752 in the upper-lower direction (the Z-axis direction). Accordingly, in comparison with a case in which the second connection portion 757 is disposed at either one of both ends of the third plate-shaped portion 752, the second left lead pin 732 can be stably connected to the third plate-shaped portion 752.

In the present embodiment, since the second plate-shaped portion 751 is disposed between the third plate-shaped portion 752 and the second intermediate portion 753 in the front-rear direction (the X-axis direction), the second left terminal member 750 can be stably fixed to the second left fixing portion 914 in comparison with a case in which the second plate-shaped portion 751 is not disposed between the third plate-shaped portion 752 and the second intermediate portion 753.

Various modifications to the above-described embodiment are conceivable.

Figure 5:
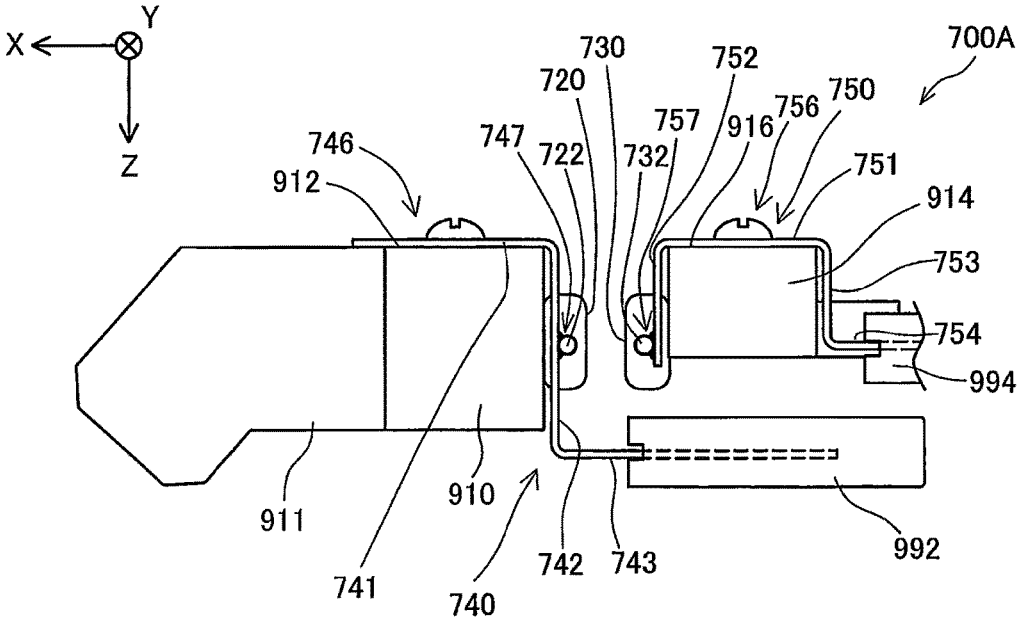
FIG. 5 is a left side view of a top cover 900, a first heater 720, a second heater 730, a first left terminal member 740, and a second left terminal member 750 of a fixing device 700A according to a modification to the embodiment.

A fixing device 700A according to one modification to the above-described embodiment will be described while referring to FIG. 5, wherein like parts and components are designated by the same reference numerals as those of the above-described embodiment to avoid duplicating description.

In the above-described embodiment, the second plate-shaped portion 751 is disposed at a position offset from the first plate-shaped portion 741 in the upper-lower direction. However, in the fixing device 700A illustrated in FIG. 5, the second plate-shaped portion 751 of the second left terminal member 750 is disposed at a position the same as the first plate-shaped portion 741 of the first left terminal member 740 in the upper-lower direction. That is, the first fixed portion 746 and the second fixed portion 756 are arrayed in the front-rear direction (the X-axis direction). The first left lead pin 722 is connected to the first intermediate portion 742. The first left lead pin 722 is disposed on the rear side (downstream side in the negative X-axis direction) relative to the first intermediate portion 742 in the front-rear direction and is connected to a rear surface of the first intermediate portion 742. That is, the first left lead pin 722 is disposed on the same side as the second left lead pin 732 with respect to the first intermediate portion 742. The first heater 720 and the second heater 730 are arrayed in the front-rear direction. Thus, in this modification, the array direction of heaters L1 is also parallel to the X-axis direction.

In the fixing device 700A, the first left lead pin 722 is disposed on the same side as the second left lead pin 732 with respect to the first intermediate portion 742 in the array direction of heaters L1 (the X-axis direction). That is, in the array direction of heaters L1, the first intermediate portion 742 is not disposed between the first left lead pin 722 and the second left lead pin 732. Accordingly, in comparison with a case in which the first intermediate portion 742 is disposed between the first left lead pin 722 and the second left lead pin 732 in the array direction of heaters, the distance between the first heater 720 and the second heater 730 can be decreased, thereby decreasing the size of the fixing device 700. Further, the distance between the first left terminal member 740 and the second left terminal member 750 can be secured. Hence, the electrical insulation between the first left terminal member 740 and the second left terminal member 750 can be secured.

In the above-described embodiment, the first left lead pin 722 of the first heater 720 is fixed to the first left terminal member 740 by welding. However, the first left lead pin 722 of the first heater 720 may be fixed to the first left terminal member 740 by press-fit. The same may apply to the second left lead pin 732 of the second heater 730.

In the above-described embodiment, the first left terminal member 740 is fixed to the first fixing surface 912 by the screw 726. However, for example, an insertion hole may be formed in the first fixing surface 912. In this case, the first left terminal member 740 may be inserted into the insertion hole of the first fixing surface 912 for fixation to the first fixing surface 912. The same may apply to the second left terminal member 750.

In the above-described embodiment, the second electrical connection portion includes the second intermediate portion 753. However, the second intermediate portion 753 is not necessarily required for the second electrical connection portion. For example, the second electrical connection portion may only include the second tip portion 754 that is aligned in a direction from the first heater 720 to the second heater 730.

In the above-described embodiment, the first fixing surface 912 and the second fixing surface 916 are both formed on the top cover 900 as a frame. However, a frame formed with the first fixing surface 912 and a frame formed with the second fixing surface 916 may be provided separately.

The configuration of the printer 10 in the above-described embodiment is only an example and can be modified in various forms. In the above-described embodiment, the printer 10 performs printing operations using single-color (black) toner. However, the types of toner colors and the number of colors used for printing operations are not limited thereto.

The image forming apparatus is not limited to only the printer 10, but may be a copier, a facsimile machine, or a multi-function machine. The disclosure can be applied to the copier and the like.

In the above-described embodiment, a halogen heater is exemplified as the first heater 720 and the second heater 730 of the fixing device 700. However, an infrared heater or a carbon heater may be available for the first heater 720 and the second heater 730, for example.

While the description has been made in detail with reference to the embodiments thereof, it would be apparent to those skilled in the art that many modifications and variations may be made therein without departing from the scope of the disclosure.

What is claimed is:

1. A fixing device comprising:
- a first heater including:
  - a first glass tube elongated in an elongated direction and having one end in the elongated direction;
  - a first heating body disposed inside the first glass tube; and
  - a first lead portion protruding from the one end of the first glass tube and electrically connected to the first heating body;
- a second heater including:
  - a second glass tube elongated in the elongated direction and having one end in the elongated direction;
  - a second heating body disposed inside the second glass tube; and
  - a second lead portion protruding from the one end of the second glass tube and electrically connected to the second heating body, the first heater and the second heater being arrayed in a first array direction;
- a frame including a first fixing surface and a second fixing surface;
- a first terminal member having a plate shape and including:
  - a first plate-shaped portion extending in the first array direction and including:
    - a first connection portion to which the first lead portion is fixed, the first connection portion being electrically connected to the first lead portion; and
    - a first fixed portion fixed to the first fixing surface; and
- a second terminal member having a plate shape and including:
  - a second plate-shaped portion extending in the first array direction and including a second fixed portion fixed to the second fixing surface, and
  - a third plate-shaped portion bent from the second plate-shaped portion in a prescribed direction crossing the first array direction, the third plate-shaped portion including
    - a second connection portion to which the second lead portion is fixed, the second connection portion being electrically connected to the second lead portion; and
    - the first fixed portion and the second fixed portion being arrayed in a second array direction, the first array direction being inclined relative to the second array direction when viewed in the elongated direction.

2. The fixing device according to claim 1, wherein the second plate-shaped portion has:
- a first end in the first array direction; and
- a second end opposite to the first end in the first array direction, the second end being positioned closer to the first lead portion than the first end to the first lead portion in the first array direction, and
- wherein the third plate-shaped portion is bent from the second end of the second plate-shaped portion and extends in the prescribed direction, the prescribed direction being a direction from the first lead portion to the first connection portion.

3. The fixing device according to claim 2, wherein the third plate-shaped portion and the first lead portion of the first heater are positioned on opposite sides of the second lead portion of the second heater in the first array direction.

4. The fixing device according to claim 3, wherein the third plate-shaped portion has:
- a first end in the prescribed direction; and
- a second end opposite to and downstream relative to the first end of the third plate-shaped portion in the prescribed direction, the first end of the third plate-shaped portion being positioned upstream relative to the first lead portion in the prescribed direction, the second end of the third plate-shaped portion being positioned downstream relative to the first lead portion in the prescribed direction.

5. The fixing device according to claim 3, wherein the third plate-shaped portion has:

a first end in the prescribed direction; and a second end opposite to and downstream relative to the first end of the third plate-shaped portion in the prescribed direction, the first end of the third plate-shaped portion being positioned upstream relative to the second lead portion in the prescribed direction, the second end of the third plate-shaped portion being positioned downstream relative to the second lead portion in the prescribed direction.

6. The fixing device according to claim 1, wherein the second plate-shaped portion of the second terminal member and the first connection portion are positioned on opposite sides of the first lead portion of the first heater in a perpendicular direction perpendicular to the first array direction and the elongated direction.

7. The fixing device according to claim 1, wherein the first plate-shaped portion has a plate shape.

8. The fixing device according to claim 4, further comprising a first connector engaged with the first terminal member, wherein the first terminal member further includes a first electrical connection portion connecting the first connection portion to the first connector, wherein the first plate-shaped portion has a closest end closest to the second lead portion in the first array direction, and wherein the first electrical connection portion includes a fourth-plate shaped portion, the fourth plate-shaped portion being bent from the closest end of the first plate-shaped portion and extending in the prescribed direction.

9. A fixing device comprising:

a first heater including:

a first glass tube elongated in an elongated direction and having one end in the elongated direction;

a first heating body disposed inside the first glass tube; and a first lead pin protruding from the one end of the first glass tube and electrically connected to the first heating body;

a second heater including:

a second glass tube elongated in the elongated direction and having one end in the elongated direction;

a second heating body disposed inside the second glass tube; and a second lead pin protruding from the one end of the second glass tube and electrically connected to the second heating body, the first heater and the second heater being arrayed in a first array direction;

a frame including a first fixing surface and a second fixing surface;

a first metal terminal member including:

a first plate-shaped portion extending in the first array direction and including:

a first connection portion to which the first lead pin is fixed, the first connection portion being electrically connected to the first lead pin; and a first fixed portion fixed to the first fixing surface;

a first connector engaged with the first metal terminal member and electrically connected to the first metal terminal member;

a second metal terminal member including:

a second plate-shaped portion extending in the first array direction and including a second fixed portion fixed to the second fixing surface; and a third plate-shaped portion bent from the second plate-shaped portion in a prescribed direction crossing the first array direction, the third-plate shaped portion including a second connection portion to which the second lead pin is fixed, the second connection portion being electrically connected to the second lead pin; and the first fixed portion and the second fixed portion being arrayed in a second array direction, the first array direction being inclined relative to the second array direction when viewed in the elongated direction; and a second connector engaged with the second metal terminal member and electrically connected to the second metal terminal member.

10. The fixing device according to claim 9, wherein the second plate-shaped portion has:

a first end in the first array direction; and a second end opposite to the first end in the first array direction, the second end being positioned closer to the first lead pin than the first end to the first lead pin in the first array direction, and wherein the third plate-shaped portion is bent from the second end of the second plate-shaped portion and extends in the prescribed direction, the prescribed direction being a direction -from the first lead pin to the first connection portion.

11. The fixing device according to claim 10, wherein the third plate-shaped portion and the first lead pin of the first heater are positioned on opposite sides of the second lead pin of the second heater in the first array direction.

12. The fixing device according to claim 11, wherein the third plate-shaped portion has:

a first end in the prescribed direction; and a second end opposite to and downstream relative to the first end of the third plate-shaped portion in the prescribed direction, the first end of the third plate-shaped portion being positioned upstream relative to the first lead pin in the prescribed direction, the second end of the third plate-shaped portion being positioned downstream relative to the first lead pin in the prescribed direction.

13. The fixing device according to claim 11, wherein the third plate-shaped portion has:

a first end in the prescribed direction; and a second end opposite to and downstream relative to the first end of the third plate-shaped portion in the prescribed direction, the first end of the third plate-shaped portion being positioned upstream relative to the second lead pin in the prescribed direction, the second end of the third plate-shaped portion being positioned downstream relative to the second lead pin in the prescribed direction.

14. A fixing device comprising:

a first heater including:

a first glass tube elongated in an elongated direction and having one end in the elongated direction;

a first heating body disposed inside the first glass tube; and a first lead pin protruding from the one end of the first glass tube and electrically connected to the first heating body;

a second heater including:

a second glass tube elongated in the elongated direction and having one end in the elongated direction;

a second heating body disposed inside the second glass tube; and a second lead pin protruding from the one end of the second glass tube and electrically connected to the second heating body;

a frame including a first fixing surface and a second fixing surface;

a first terminal member having a plate shape and including:

a first connection portion to which the first lead pin is fixed, the first connection portion being electrically connected to the first lead pin;

a first fixed portion fixed to the first fixing surface; and a primary plate-shaped portion including the first connection portion; and a second terminal member having a plate shape and including:

a second connection portion to which the second lead pin is fixed, the second connection portion being electrically connected to the second lead pin;

a second fixed portion fixed to the second fixing surface; and a secondary plate-shaped portion including the second connection portion and extending in a prescribed direction, the prescribed direction being a direction from the first lead pin to the first connection portion, the secondary plate-shaped portion and the first lead pin being positioned on opposite sides of the second lead pin.

15. The fixing device according to claim 14, wherein the second terminal member further includes a tertiary plate-shaped portion including the second fixed portion, and wherein the secondary plate-shaped portion is bent from the tertiary plate-shaped portion.

16. The fixing device according to claim 14, wherein the secondary plate-shaped portion has:

a first end in the prescribed direction; and a second end opposite to and downstream relative to the first end of the secondary plate-shaped portion in the prescribed direction, the first end of the secondary plate-shaped portion being positioned upstream relative to the first lead pin in the prescribed direction, the second end of the secondary plate-shaped portion being positioned downstream relative to the first lead pin in the prescribed direction.

17. The fixing device according to claim 14, wherein the secondary plate-shaped portion has:

a first end in the prescribed direction; and a second end opposite to and downstream relative to the first end of the secondary plate shaped portion in the prescribed direction, the first end of the secondary plate-shaped portion being positioned upstream relative to the second lead pin in the prescribed direction, the second end of the secondary plate-shaped portion being positioned downstream relative to the second lead pin in the prescribed direction.

18. The fixing device according to claim 17, wherein the primary plate-shaped portion has a plate shape and further includes the first fixed portion.

* * * * *